US006421958B2

(12) United States Patent
Weder

(10) Patent No.: US 6,421,958 B2
(45) **Date of Patent: *Jul. 23, 2002**

(54) FLORAL SLEEVE CONVERTIBLE INTO A DECORATIVE SKIRT

(75) Inventor: Donald E. Weder, Highland, IL (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/777,568

(22) Filed: Feb. 6, 2001

Related U.S. Application Data

(63) Continuation of application No. 09/298,311, filed on Apr. 23, 1999, now Pat. No. 6,195,937, which is a continuation of application No. 08/781,312, filed on Jan. 9, 1997, now abandoned, which is a continuation-in-part of application No. 08/453,719, filed on May 30, 1995, now abandoned, which is a continuation of application No. 08/220,852, filed on Mar. 31, 1994, now Pat. No. 5,572,851.

(51) Int. Cl.[7] ..... A47G 7/08
(52) U.S. Cl. ..... 47/72
(58) Field of Search ..... 417/72

(56) References Cited

U.S. PATENT DOCUMENTS

| | | | |
|---|---|---|---|
| 524,219 A | 8/1894 | Schmidt | |
| 732,889 A | 7/1903 | Paver | |
| 950,785 A | 3/1910 | Pene | |
| 1,044,260 A | 11/1912 | Schloss | |
| 1,063,154 A | 5/1913 | Bergen | |
| 1,446,563 A | 2/1923 | Hughes | |
| 1,520,647 A | 12/1924 | Hennigan | |
| 1,525,015 A | 2/1925 | Weeks | |
| 1,610,652 A | 12/1926 | Bouchard | |
| 1,697,751 A | 1/1929 | Blake | 229/87 |
| 1,794,212 A | 2/1931 | Snyder | |
| 1,811,574 A | 6/1931 | Barrett | |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 345464 | 12/1921 |
| DE | 513971 | 11/1930 |

(List continued on next page.)

OTHER PUBLICATIONS

Speed Cover Brochure, "The Simple Solution For Those Peak Volume Periods", Highland Supply Corporation, ©1989.

(List continued on next page.)

*Primary Examiner*—Peter M. Poon
*Assistant Examiner*—Jeffrey L. Gellner
(74) *Attorney, Agent, or Firm*—Dunlap, Codding & Roger, P.C.

(57) ABSTRACT

A floral sleeve having an upper portion, a lower portion and a medial portion. The floral sleeve can be placed about a plant container such as a potted plant such that the lower portion contains the pot, and the upper portion surrounds the plant. When desired, the upper portion and lower portion can be detached, leaving the medial portion which can be attached to the pot forming a skirt extending from the upper end thereof.

13 Claims, 2 Drawing Sheets

U.S. PATENT DOCUMENTS

| | | | | |
|---|---|---|---|---|
| 1,863,216 | A | 6/1932 | Wordingham | |
| 1,978,631 | A | 10/1934 | Herrlinger | 91/68 |
| 2,048,123 | A | 7/1936 | Howard | 229/87 |
| RE21,065 | E | 5/1939 | Copeman | 93/2 |
| 2,170,147 | A | 8/1939 | Lane | 206/56 |
| 2,200,111 | A | 5/1940 | Bensel | 229/1.5 |
| 2,278,673 | A | 4/1942 | Savada et al. | 154/43 |
| 2,302,259 | A | 11/1942 | Rothfuss | 41/10 |
| 2,323,287 | A | 7/1943 | Amberg | 229/53 |
| 2,355,559 | A | 8/1944 | Renner | 229/8 |
| 2,371,985 | A | 3/1945 | Freiberg | 206/46 |
| 2,411,328 | A | 11/1946 | MacNab | 33/12 |
| 2,510,120 | A | 6/1950 | Leander | 117/122 |
| 2,529,060 | A | 11/1950 | Trillich | 117/68.5 |
| 2,621,142 | A | 12/1952 | Wetherell | 154/117 |
| 2,648,487 | A | 8/1953 | Linda | 229/55 |
| 2,688,354 | A | 9/1954 | Berger | 150/28 |
| 2,774,187 | A | 12/1956 | Smithers | 47/41 |
| 2,822,287 | A | 2/1958 | Avery | 117/14 |
| 2,846,060 | A | 8/1958 | Yount | 206/58 |
| 2,850,842 | A | 9/1958 | Eubank, Jr. | 47/58 |
| 2,883,262 | A | 4/1959 | Borin | 21/56 |
| 2,989,828 | A | 6/1961 | Warp | 53/390 |
| 3,022,605 | A | 2/1962 | Reynolds | 47/58 |
| 3,080,680 | A | 3/1963 | Reynolds | 47/37 |
| 3,094,810 | A | 6/1963 | Kalpin | 47/37 |
| 3,121,647 | A | 2/1964 | Harris et al. | 118/202 |
| 3,130,113 | A | 4/1964 | Silman | 161/97 |
| 3,271,922 | A | 9/1966 | Wallerstein et al. | 53/3 |
| 3,322,325 | A | 5/1967 | Bush | 229/62 |
| 3,376,666 | A | 4/1968 | Leonard | 47/41 |
| 3,380,646 | A | 4/1968 | Doyen et al. | 229/57 |
| 3,431,706 | A | 3/1969 | Stuck | 53/390 |
| 3,508,372 | A | 4/1970 | Wallerstein et al. | 53/3 |
| 3,510,054 | A | 5/1970 | Sanni et al. | 229/66 |
| 3,512,700 | A | 5/1970 | Evans et al. | 229/53 |
| 3,550,318 | A | 12/1970 | Remke et al. | 47/37 |
| 3,552,059 | A | 1/1971 | Moore | 47/41.12 |
| 3,554,434 | A | 1/1971 | Anderson | 229/55 |
| 3,556,389 | A | 1/1971 | Gregoire | 229/53 |
| 3,557,516 | A | 1/1971 | Brandt | 53/14 |
| 3,620,366 | A | 11/1971 | Parkinson | 206/59 |
| 3,681,105 | A | 8/1972 | Milutin | 117/15 |
| 3,767,104 | A | 10/1973 | Bachman et al. | 229/7 |
| 3,793,799 | A | 2/1974 | Howe | 53/32 |
| 3,869,828 | A | 3/1975 | Matsumoto | 47/34.11 |
| 3,888,443 | A | 6/1975 | Flanigen | 248/152 |
| 3,962,503 | A | 6/1976 | Crawford | 428/40 |
| 4,043,077 | A | 8/1977 | Stonehocker | 47/66 |
| 4,054,697 | A | 10/1977 | Reed et al. | 428/40 |
| 4,091,925 | A | 5/1978 | Griffo et al. | 206/423 |
| 4,113,100 | A | 9/1978 | Soja et al. | 206/602 |
| 4,118,890 | A | 10/1978 | Shore | 47/28 |
| 4,189,868 | A | 2/1980 | Tymchuck et al. | 47/84 |
| 4,216,620 | A | 8/1980 | Weder et al. | 47/72 |
| 4,248,347 | A | 2/1981 | Trimbee | 206/423 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,297,811 | A | 11/1981 | Weder | 47/72 |
| 4,333,267 | A | 6/1982 | Witte | 47/84 |
| 4,347,686 | A | 9/1982 | Wood | 47/73 |
| 4,380,564 | A | 4/1983 | Cancio et al. | 428/167 |
| 4,400,910 | A | 8/1983 | Koudstall et al. | 47/84 |
| 4,413,725 | A | 11/1983 | Bruno et al. | 206/45.33 |
| D279,279 | S | 6/1985 | Wagner | D11/143 |
| 4,546,875 | A | 10/1985 | Zweber | 206/0.82 |
| 4,621,733 | A | 11/1986 | Harris | 206/423 |
| 4,640,079 | A | 2/1987 | Stuck | 53/390 |
| 4,717,262 | A | 1/1988 | Roen et al. | 383/120 |
| 4,733,521 | A | 3/1988 | Weder et al. | 53/580 |
| 4,765,464 | A | 8/1988 | Ristvedt | 206/0.82 |
| 4,771,573 | A | 9/1988 | Stengel | 47/67 |
| 4,773,182 | A | 9/1988 | Weder et al. | 47/72 |
| 4,801,014 | A | 1/1989 | Meadows | 206/423 |
| 4,810,109 | A | 3/1989 | Castel | 383/105 |
| 4,835,834 | A | 6/1989 | Weder | 29/525 |
| D301,991 | S | 7/1989 | Van Sant | D11/149 |
| 4,941,572 | A | 7/1990 | Harris | 206/423 |
| 4,980,209 | A | 12/1990 | Hill | 428/34.1 |
| 4,989,396 | A | 2/1991 | Weder et al. | 53/397 |
| D315,700 | S | 3/1991 | Stephens | D11/151 |
| 5,073,161 | A | 12/1991 | Weder et al. | 493/154 |
| 5,074,675 | A | 12/1991 | Osgood | 383/122 |
| 5,105,599 | A | 4/1992 | Weder | 53/399 |
| 5,111,638 | A | 5/1992 | Weder | 53/397 |
| 5,120,382 | A | 6/1992 | Weder | 156/212 |
| 5,152,100 | A | 10/1992 | Weder et al. | 47/72 |
| 5,181,364 | A | 1/1993 | Weder | 53/397 |
| D335,105 | S | 4/1993 | Ottenwalder et al. | D11/164 |
| 5,199,242 | A | 4/1993 | Weder et al. | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,239,775 | A | 8/1993 | Lanndau | 47/72 |
| 5,249,407 | A | 10/1993 | Stuck | 53/399 |
| 5,259,106 | A | 11/1993 | Weder et al. | 29/469.5 |
| 5,307,606 | A | 5/1994 | Weder | 53/410 |
| 5,315,785 | A | 5/1994 | Avôt et al. | 47/72 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,428,939 | A | 7/1995 | Weder et al. | 53/397 |
| 5,443,670 | A | 8/1995 | Landau | 156/191 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,572,849 | A | 11/1996 | Weder et al. | 53/399 |
| 5,572,851 | A * | 11/1996 | Weder | 53/399 |
| 5,575,133 | A | 11/1996 | Weder et al. | 53/397 |
| 5,617,703 | A | 4/1997 | Weder | 53/413 |
| 5,624,320 | A | 4/1997 | Martinez | 472/51 |
| 5,625,979 | A | 5/1997 | Weder | |
| 5,647,168 | A | 7/1997 | Gilbert | 47/72 |
| 5,647,193 | A | 7/1997 | Weder et al. | 53/465 |
| 5,715,944 | A | 2/1998 | Windisch | 206/423 |
| D404,684 | S | 1/1999 | Shea | D11/164 |
| 6,006,496 | A * | 12/1999 | Weder | 53/399 |
| D419,436 | S | 1/2000 | Celtorius et al. | D9/305 |
| 6,129,209 | A | 10/2000 | Tchira | 206/423 |
| 6,195,937 | B1 * | 3/2001 | Weder | 47/72 |

FOREIGN PATENT DOCUMENTS

| | | |
|---|---|---|
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2610604 | 8/1988 |

| | | |
|---|---|---|
| FR | 2603159 | 3/1989 |
| FR | 2619698 | 3/1989 |
| GB | 5605 | 5/1885 |
| GB | 1204647 | 9/1970 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 542958 | 2/1993 |
| NL | 8301709 | 12/1984 |
| NL | 1000658 | 1/1996 |
| WO | 9315979 | 8/1993 |

OTHER PUBLICATIONS

"Speed Sheets and Speed Rolls" Brochure, Highland Supply Corporation, ©1990.

"Color Them Happy with Highlander Products" ©1992.

"Costa Keeps the Christmas Spirit", Supermarket Floral, Sep. 15, 1992.

"Super Seller", Supermarket Floral, Sep. 15, 1992.

"Halloween", Link Magazine, Sep. 1992.

"Now More Than Ever", Supermarket Floral, Sep. 15, 1992.

Le Plant Sac Advertisement, published prior to Sep. 26, 1987.

"A World of Cut Flower and Pot Plant Packaging" Brochure, Klerk's Plastic Products Manufacturing, Inc., published prior to Mar. 31, 1994, 6 pages.

Chantler & Chantler brochure showing Zipper Sleeve™ and Florasheet®, published prior to Mar. 31, 1994, 2 pages.

"Stand Alone Plastic Bagmaking" brochure, AMI, Atlanta, GA, Feb. 15, 1996, 2 pages.

"Foil Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

"Special Occasion Printed Highlophane Bags" Brochure, Highland Supply Corporation, 1990, 2 pages.

* cited by examiner

FLORAL SLEEVE CONVERTIBLE INTO A DECORATIVE SKIRT

The present application is a continuation of U.S. Ser. No. 09/298,311, filed Apr. 23, 1999, now U.S. Pat. No. 6,195,937 which is a continuation of U.S. Ser. No. 08/781,312, filed Jan. 9, 1997, now abandoned, which is a continuation-in-part of U.S. Ser. No. 08/453,719, filed May 30, 1995, now abandoned, which is a continuation of U.S. Ser. No. 08/220,852, filed Mar. 31, 1994, now U.S. Pat. No. 5,572,851, issued on Nov. 12, 1996, the specifications of each of which are hereby incorporated by reference herein.

STATEMENT REGARDING FEDERALLY SPONSORED RESEARCH OR DEVELOPMENT

Not Applicable

BACKGROUND OF INVENTION

Floral sleeves have long been used in the floral industry for covering potted plants for protection during shipment. After shipment the sleeves are usually removed and completely discarded. This practice can be wasteful and time consuming. Thus a floral sleeve which could be converted to provide a decorative, as well as protective, effect would be useful.

DESCRIPTION OF THE PREFERRED EMBODIMENTS

Figure 1:
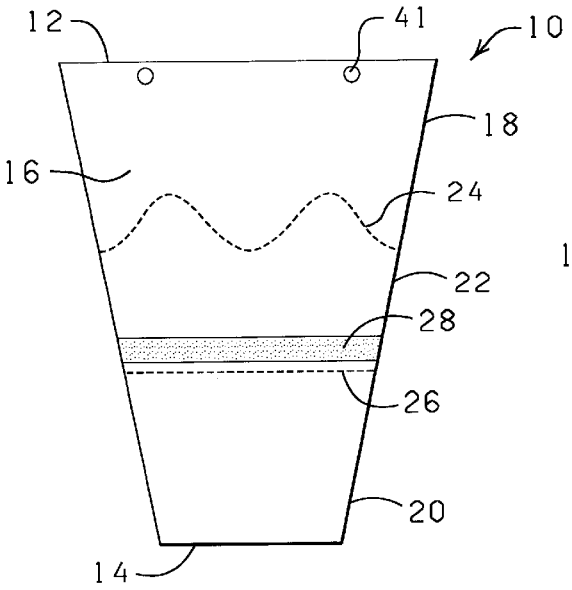
FIG. 1 is a side perspective view of a sleeve constructed in accordance with the present invention.

The present invention contemplates such a floral sleeve wherein a portion of the sleeve can be converted into a skirt for providing both a decorative and functional use of the sleeve.

In one version, the floral sleeve is a wrapper for a plant container, and comprises a flexible tubular sleeve performed and dimensioned to fit a plant container having a specific size and shape and the sleeve having an upper end, a lower end, an outer peripheral surface, and an inner peripheral surface, and having an upper sleeve portion, a base portion and a medial portion positioned between the upper sleeve portion and the base portion. The upper sleeve portion is detachable from the medial portion via upper detaching means and the base portion is detachable from the medial portion via lower detaching means. The lower detaching means is positioned so that when the plant container is placed within the base portion the lower detaching means is located a distance below an upper rim of the plant container for allowing attachment of a portion of the medial portion to the plant container. When the upper sleeve portion and the base portion are detached from the medial portion, the medial portion is attachable to a surface of the plant container forming a skirt which extends away from the upper rim of the plant container. The upper detaching means and the lower detaching means may comprise perforations. The lower end may be open but is preferably closed. Preferably, the wrapper has a first panel and a second panel forming a tube shape with an interior space and is initially in a flattened condition.

In another version, the invention contemplates a wrapper for a plant container which comprises a flexible tubular sleeve having an upper end, a lower end, an outer peripheral surface, and an inner peripheral surface, and an interior surface, and having an upper sleeve portion, a base portion and a medial portion positioned between the upper sleeve portion and the base portion. The medial portion has a bonding material disposed upon a portion thereof for attaching to a portion of the plant container, and the upper sleeve portion is detachable from the medial portion via first detaching means and the base portion is detachable from the medial portion via second detaching means. When the upper sleeve portion and the base portion are detached from the medial portion, the medial portion is attachable to a surface of the plant container via the bonding material forming a skirt which extends away from the upper end of the plant container.

The invention further contemplates a method of covering a plant container, comprising the steps of: (1) providing a plant container having an upper end, a lower end, an outer surface, an inner surface, and an interior space, and having a floral grouping disposed within the interior space and extending a distance above the upper end of the plant container, (2) disposing the plant container into a flexible tubular sleeve having an upper portion, a base portion, and a medial portion, the medial portion positioned between the upper portion and the base portion, wherein the base portion substantially encompasses the plant container and the upper portion substantially encompasses the floral grouping, (3) detaching the upper portion and the base portion from the medial portion, and (4) attaching the medial portion to a surface of the plant container wherein the medial portion forms a skirt extending away from the upper end of the plant container. The medial portion may be attached via bonding means or via banding means.

In another version, steps 3 and 4 may be reversed wherein the medial portion is first attached to a surface of the plant container, and the upper portion and the base portion are then detached from the medial portion wherein the medial portion forms a skirt extending away from the upper end of the plant container.

Shown in FIG. 1 and designated by the general reference numeral 10 is a tubular floral sleeve constructed in accordance with the present invention. The sleeve 10 has an upper end 12, a lower end 14, and an outer peripheral surface 16. The lower end 14 may be open or closed. If closed, the lower end 14 may have a straight sealed edge or a gusset or excess material for allowing expansion of the lower end. The sleeve 10 further comprises an upper portion 18, a lower portion 20 and a medial portion 22 disposed between the upper portion 18 and the lower portion 20. The upper portion 18 is detachable from the upper end of the medial portion 22 via upper detaching means 24 which in a preferred embodiment is a plurality of perforations. The lower portion 20 is detachable from the lower end of the medial portion 22 via lower detaching means 26 which in a preferred embodiment is a plurality of perforations. The detaching means may be perforations, tear strips, zippers, or any other means for detaching which function in accordance with the present invention. The lower detaching means 26 is positioned in the sleeve 10 at a position so that when a pot or floral container is disposed within the sleeve 10, the detaching means 26 is located a distance 27 below the upper rim of the pot so that a portion of the medial portion 22 can be attached to a portion of the outer or inner surface of the pot.

The sleeve 10 preferably further comprises a bonding material 28 disposed upon a portion of the outer peripheral surface 16 as shown in FIG. 1. In those versions having the bonding material, the bonding material 28 is disposed on the medial portion 22 in a position between the upper detaching means 24 and the lower detaching means 26. Equipment and devices for forming sleeves and for forming perforations therein are well known in the art and may be seen in U.S. Pat. No. 5,493,809, the specification of which is hereby incorporated by reference herein.

Figure 2:
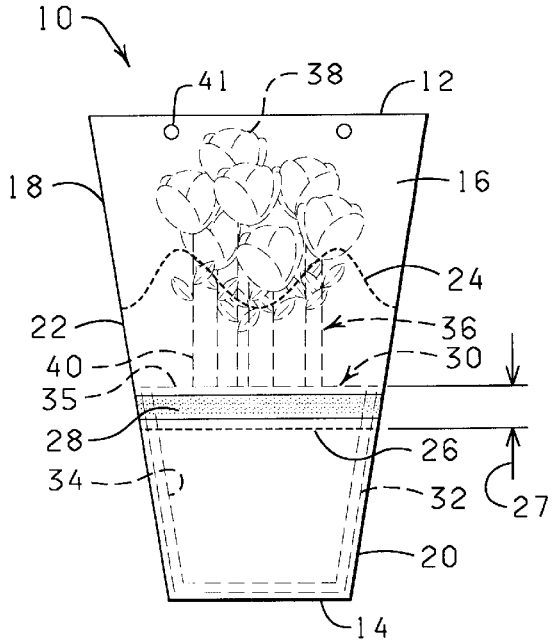
FIG. 2 is a side view of a pot disposed within the sleeve of FIG. 1.

FIG. 2 shows a plant assembly comprising a pot 30 which is contained within the sleeve 10. The pot 30 has an outer surface 32, an inner surface 34, and an upper rim 35. The pot 30 generally contains a floral grouping 36, however, in another embodiment of the invention the pot may be empty or partially empty. As shown in FIG. 2, the area of bonding material 28 on the sleeve 10 preferably is positioned adjacent a portion of the pot 30 near the upper rim 35 thereof. The term "pot", "pot means", or "floral container" as used herein refers to any type of container used for holding a floral grouping or a potted plant. Examples of pots, used in accordance with the present invention include, but are not limited to, clay pots, wooden pots, plastic pots, vases, and the like.

The floral grouping 36 may be disposed within the pot 30, along with a suitable growing medium, which will be described in further detail below, or other retaining medium, such as, but not limited to, a floral foam. The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping 36. The floral grouping 36 comprises a bloom or foliage portion 38 and a stem portion 40. Further, the floral grouping 36 may comprise a growing plant having a root portion (not shown) as well. However, it will be appreciated that the floral grouping 36 may consist of only a single bloom or only foliage, or a botanical item (not shown), or a propagule (not shown). The term "floral grouping" may be used interchangeably herein with both the terms "floral arrangement" and "potted plant".

The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

It will be understood that the bonding material 28 may be disposed in a solid section of bonding material. Further, the bonding material 28 may be disposed in strips, or spots, or in any other geometric, non-geometric, asymmetric, or fanciful form. The bonding material 28 is disposed on the sleeve 10 and/or pot 30 by any means known in the art such as spraying or brushing.

The sleeve 10 is generally conically shaped, but the sleeve 10 may be, by way of example but not by way of limitation, cylindrical, frusto-conical, or a combination of both frusto-conical and cylindrical (not shown). Further, as long as a generally tubular shape is maintained in at least a portion of the sleeve 10, any shape, whether geometric, non-geometric, asymmetrical and/or fanciful may be utilized.

The sleeve 10 preferably has a thickness in a range from about 0.1 mils to about 30 mils. Often, the thickness of the sleeve 10 is in a range from about 0.5 mils to about 10 mils. Preferably, the sleeve 10 has a thickness in a range from about 0.1 mils to about 5 mils. The sleeve 10 is constructed of a material which is flexible.

The sleeve 10 may be constructed of a single layer of material or a plurality of layers of the same or different types of materials. Any thickness of the material may be utilized in accordance with the present invention as long as the material is wrappable about a pot 30, as described herein. The layers of material comprising the sleeve 10 may be connected together or laminated or may be separate layers. Materials used to construct the sleeve 10 are described in U.S. Pat. No. 5,111,637, which is hereby incorporated herein by reference.

The term "bonding material or means" when used herein means an adhesive, frequently a pressure sensitive adhesive, or a cohesive. Where the bonding material is a cohesive, a similar cohesive material must be placed on the adjacent (e.g., the adjacent surface of the pot 30) surface for bondingly contacting and bondingly engaging with the cohesive material. The term "bonding material or means" also includes materials which are heat sealable and, in this instance, the adjacent portions of the material must be brought into contact and then heat must be applied to effect the seal. The term "bonding material or means" also includes materials which are sonic sealable and vibratory sealable. The term "bonding material or means" when used herein also means a heat sealing lacquer or hot melt material which may be applied to the material and, in this instance, heat, sound waves, or vibrations, also must be applied to effect the sealing.

Alternatively, a cold seal using a cold seal adhesive is utilized upon the material to form a sleeve. The term "bonding material or means" includes this cold seal adhesive. The cold seal adhesive adheres only to a similar substrate, acting similarly as a cohesive, and binds only to itself. The cold seal adhesive, since it adheres (or coheres) only to a similar substrate, does not cause a residue to build up on equipment, thereby permitting much more rapid disposition and use to form articles. A cold seal adhesive differs also from, for example, a pressure sensitive adhesive, in that a cold seal adhesive is not readily releasable.

As noted above, the sleeve 10 may be constructed of a single layer of material or a plurality of layers of the same or different types of materials. Any thickness of layer of material may be utilized in accordance with the present invention as long as the sleeve 10 may be formed into at least a portion of a sleeve 10, as described herein, and as long as the formed sleeve 10 may contain at least a portion of a pot 30 or a floral grouping 36, as described herein. Additionally, an insulating material such as bubble film, preferable as one of two or more layers, can be utilized in order to provide additional protection for the item, such as the floral grouping 36, contained therein.

Where used herein, the term "banding means" refers to elastic or plastic bands, ties, strings, ribbons, collars, or other similar tying or banding materials.

In one embodiment, the sleeve 10 may be constructed from two polypropylene films. The layers of material comprising the sleeve 10 may be connected together or laminated or may be separate layers. In an alternative embodiment, the sleeve 10 may be constructed from only one of the polypropylene films.

The sleeve 10 is constructed from any suitable material and preferably, comprises paper (untreated or treated in any manner), cellophane, metal foil, polymer film, non-polymer film, fabric (woven or nonwoven or synthetic or natural), cardboard, fiber, cloth, burlap, or laminations or combinations thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

The material comprising the sleeve 10 may vary in color. Further, the material comprising the sleeve 10 may consist of designs or decorative patterns which are printed, etched, and/or embossed thereon using inks or other printing materials. An example of an ink which may be applied to the surface of the material is described in U.S. Pat. No. 5,147,706 which is hereby incorporated herein by reference.

In addition, the sleeve material may have various colorings, coatings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper and/or lower surface of the material comprising the sleeve 10. Moreover, each surface of the material used in constructing the sleeve 10 may vary in the combination of such characteristics. The material utilized for the sleeve 10 itself may be opaque, translucent, transparent, or partially clear or tinted transparent.

The sleeve 10 may further comprise one or more apertures 42 near the upper end. The apertures 42 permit the sleeve 10, to be placed on a rod or a set of rods, also known as wickets, for shipment, storage, assembly or use of the sleeve 10. The medial portion 22 may be formed so as to turn upwardly, inwardly, horizontally (upward or inward), downwardly, vertically (either upward or downward) or in any combination thereof, or in any obtuse or arbitrary angle or combination thereof. The sleeves may also be packed so each sleeve is separate, or may be stapled together.

Figure 3:
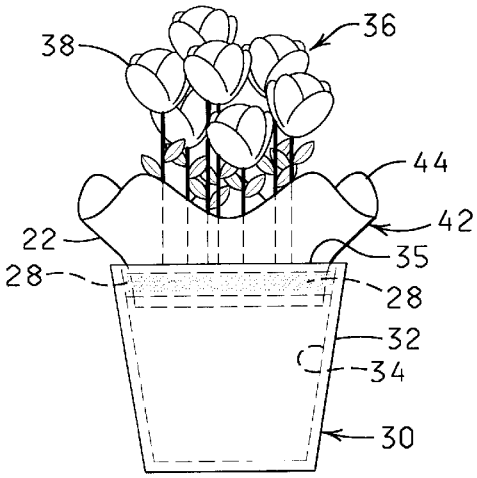
FIG. 3 is a side view of a pot having a skirt attached thereto.

In usage a plant container such as the pot 30 containing the floral grouping 36 is disposed within the sleeve 10. The plant package thus assembled can be stored, shipped or sold. If desired by the grower, shipper, seller or buyer, the upper portion 18 and the lower portion 20 of the sleeve 10 can be detached via the detaching means 24 and 26, respectively, leaving the medial portion 22 disposed as a skirt about the pot 30. As shown in FIG. 3, the free medial portion 22 can then be bondingly connected to a portion of the pot 30 near the upper end thereof. In the case of sleeve 10, where the bonding material 28 is disposed on the outer peripheral surface 16, the medial portion 22 is attached by the bonding material 28 to a portion of the inner surface 34 of the pot 30. A portion of the medial portion 22 then extends from the upper end of the pot 30 and forms a decorative skirt 42 about a portion of the floral grouping 36. Where the bonding material 28 is a cohesive material, the pot 30 also has a similar cohesive material on a portion thereof for connecting to the cohesive bonding material 28 on the sleeve 10. Thus, in the embodiment of the present invention shown in FIG. 3, the outer surface 32 of the pot 30 is exposed, and at least the bloom portion 38 of the floral grouping 36 is exposed.

Figure 4:
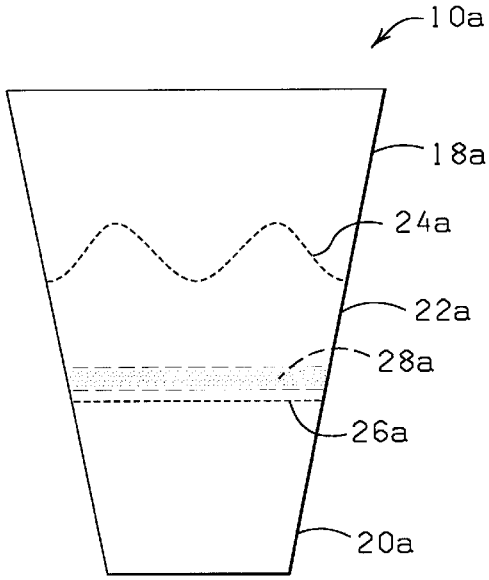
FIG. 4 is a side perspective view of another sleeve constructed in accordance with the present invention.
Figure 5:
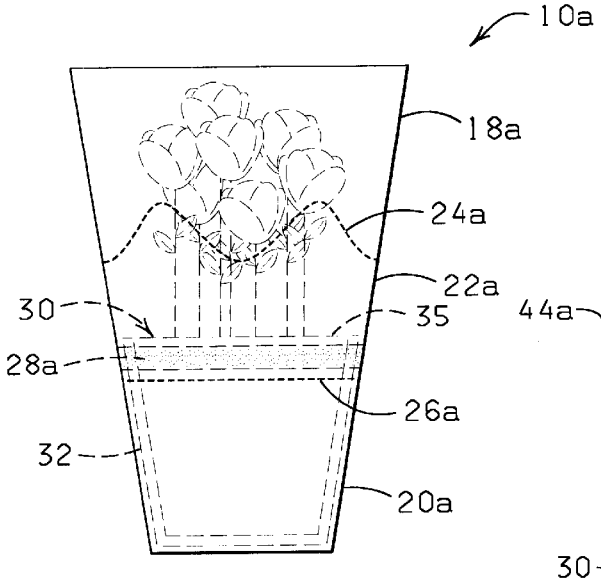
FIG. 5 is a side view of a pot disposed within the sleeve of FIG. 4.
Figure 6:
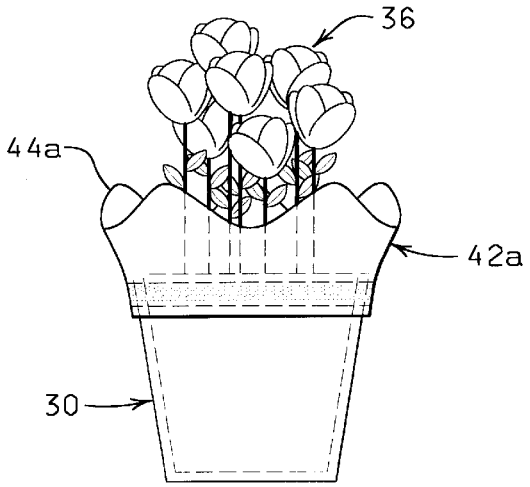
FIG. 6 is a side view of another embodiment of a pot having a skirt attached thereto.

An alternative embodiment of the invention is shown in FIG. 4 as sleeve 10*a*. Sleeve 10*a* is exactly the same as sleeve 10 described previously except that sleeve 10*a* has a bonding material 28*a* disposed on a portion of the inner surface of the medial portion 22*a* of the sleeve 10*a*. FIG. 5 shows the sleeve 10*a* disposed about a pot 30 in a similar manner as shown in FIG. 3 except the bonding material 28*a* is immediately adjacent to a portion of the outer surface 32 of the pot 30 and the bonding material 28*a* bondingly connects the medial portion 22*a* of the sleeve 10*a* to a portion of the outer surface 32 of the pot 30 near the upper end thereof. As with the sleeve 10 shown in FIGS. 1–3, an upper portion 18*a* and lower portion 20*a* can be detached via detaching means 24*a* and 26*a*, respectively, leaving the medial portion 22*a* in a position about the pot 30 and bondingly connected to the outer surface 32 thereof, via the bonding material 28*a*. A portion of the medial portion 22*a* extends away from the pot 30 comprising a decorative skirt 42*a* as shown in FIG. 6. The medial portion 22*a* of the sleeve 10*a* may be bondingly connected to the pot 30 either before, or after the detachment of the upper portion 18*a* and lower portion 20*a*.

In both embodiments shown in FIGS. 3 and 6, an upper edge 44 and 46 is formed in the skirts 42 and 42*a*, when the upper portions 18 and 18*a* are detached therefrom, respectively. The upper edges 44 and 44*a* may be linear, or may be curved (non-linear). The upper edges 44 and 44*a* may have a scalloped pattern, an inverted scalloped pattern, a sine wave pattern, a crenulated pattern or any other appropriate form. The skirt portion 42*a*, like the skirt portion 42, does not completely or substantially surround the floral grouping 36 but generally extends only near a lower portion of the floral grouping 36 for decorating the pot and floral grouping without covering the upper portion of the floral grouping and also for providing a border about the pot for reducing spillage of water or growing medium from the pot.

Figure 7:
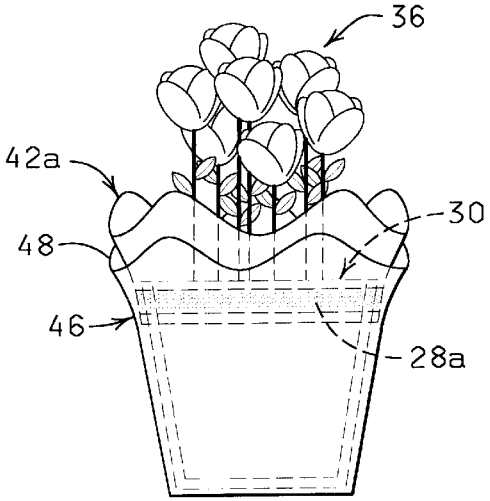
FIG. 7 is a side view of a skirt and pot such as shown in FIG. 6 with a decorative cover applied thereto.

Shown in FIG. 7 is an alternative embodiment of the invention wherein a pot 30 having a skirt 42*a* attached thereto, such as is shown in FIG. 6, has a pot cover 46 disposed thereabout to further cover or decorate the pot 30. The cover 46 may comprise a skirt portion 48 for providing a double skirt effect as shown in FIG. 7, or the cover 46 may be constructed from the same material as the skirt 42*a*, or from a different material for providing a different decorative effect.

Figure 8:
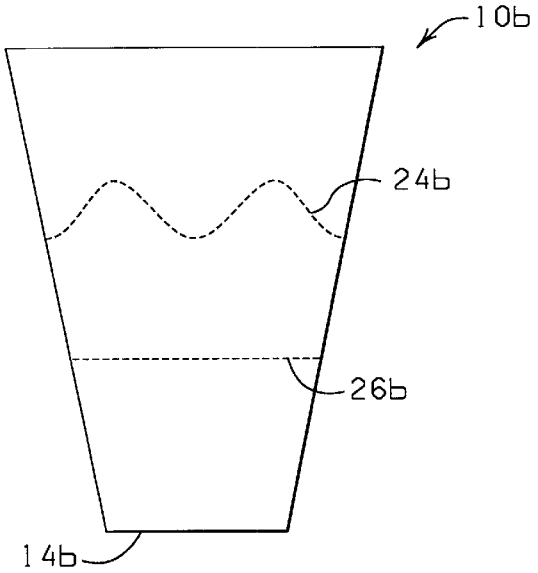
FIG. 8 is a side perspective view of another sleeve constructed in accordance with the present invention.

In alternative embodiments, instead of attaching the medial portion to the plant container via a bonding material, the medial portion may be attached to the plant container using a banding means such as a tie, ribbon or band. The banding means may be pre-connected to the sleeve or may comprise a component separate from the sleeve. FIG. 8 shows a floral sleeve lob substantially the same as the sleeves described above but which is not equipped with a bonding material thereon. Sleeve 10*b* has a closed lower end 14*b*, upper detaching means 24*b* and lower detaching means 26*b*. The sleeve 10*b* is sized and dimensioned to fit a specific pot or floral container having specific dimensions. The lower detaching means 26*b* of the sleeve 10*b* is positioned on the sleeve 10*b* so that it will be located a distance below the upper rim of the floral container which the sleeve 10*b* has been designed to fit.

Changes may be made in the construction and the operation of the various components, elements and assemblies described herein or in the steps or the sequence of steps of the methods described herein without departing from the spirit and scope of the invention as defined in the following claims.

What is claimed is:

1. A wrapper for a flower pot, comprising:

a flexible tubular sleeve having an upper end, a lower end, an outer peripheral surface, and inner peripheral surface, and an interior space, the flexible tubular sleeve having an upper sleeve portion, a base portion and a medial portion positioned between the upper sleeve portion and the base portion, and wherein the upper sleeve portion is detachable from the medial portion via upper circumferentially-oriented perforations having a non-linear pattern and wherein the base portion is detachable from the medial portion via lower circumferentially-oriented perforations, and wherein the lower circumferentially-oriented perforations are positioned so that when the flower pot is placed within the base portion of the flexible tubular sleeve, the lower circumferentially-oriented perforations are located a distance below an upper rim of the flower pot, and wherein when the upper sleeve portion of the flexible tubular sleeve is detached from the medial portion, a skirt is formed which extends away from the upper rim of the flower pot.

2. The wrapper of claim 1 wherein the lower end is open.

3. The wrapper of claim 1 wherein the lower end is closed.

4. The wrapper of claim 1 wherein the wrapper has a first panel and a second panel forming a tube shape and is initially in a flattened condition.

5. The wrapper of claim 1 further comprising a gusset in the lower end thereof.

6. A wrapper for a flower pot having an upper rim and a lower end, comprising:

a flexible tubular sleeve having an upper end, a lower end, an outer peripheral surface, and an inner peripheral surface, the flexible tubular sleeve having an upper sleeve portion, a base portion and a medial portion positioned between the upper sleeve portion and the base portion, and wherein the medial portion has a bonding material disposed upon a portion thereof for attaching to a portion of the flower pot, and wherein the upper sleeve portion is detachable from the medial portion of the flexible tubular sleeve via upper circumferentially-oriented perforations having a non-linear pattern and wherein the base portion of the flexible tubular sleeve is detachable from the medial portion via lower circumferentially- oriented perforations, and wherein when the upper sleeve portion of the flexible tubular sleeve is detached from the medial portion, a skirt is formed which extends away from the upper rim of the flower pot.

7. The wrapper of claim 6 wherein the bonding material is an adhesive or cohesive.

8. The wrapper of claim 6 wherein the bonding material is disposed upon the inner surface of the medial portion.

9. The wrapper of claim 6 wherein the bonding material is disposed upon the outer surface of the medial portion.

10. The wrapper of claim 6 wherein the lower end is open.

11. The wrapper of claim 6 wherein the lower end is closed.

12. The wrapper of claim 6 wherein the wrapper has a first panel and a second panel forming a tube shape and is initially in a flattened condition.

13. The wrapper of claim 6 further comprising a gusset in the lower end thereof.

* * * * *